US005579967A

United States Patent [19]

Berg

[11] Patent Number: 5,579,967

[45] Date of Patent: Dec. 3, 1996

[54] MOUNTING SYSTEM FOR SECURING PONY TANK TO SCUBA MAIN CYLINDERS

[76] Inventor: Daniel T. Berg, 2745 Cheshire Dr., Baldwin, N.Y. 11510

[21] Appl. No.: 349,190

[22] Filed: Dec. 5, 1994

[51] Int. Cl.[6] ..... A45F 3/14

[52] U.S. Cl. ..... 224/250; 224/934

[58] Field of Search ..... 224/250, 934; 128/201.27, 201.28, 201.29, 205.22; 211/71; 248/154, 230.8; 403/385, 389, 391

[56] References Cited

U.S. PATENT DOCUMENTS 4,629,103 12/1986 Miller ..... 224/250

4,949,889 8/1990 Carson ..... 224/270

5,411,018 5/1995 Rinehart ..... 128/201.27

*Primary Examiner*—David J. Walczak

*Attorney, Agent, or Firm*—Richard L. Miller, P.E.

[57] ABSTRACT

A pony tank mounting system comprising a joining bracket and components for securing the joining bracket to a pony tank. A structure is provided for suspending the joining bracket with the pony tank from a valve on a main scuba tank along with an assembly for attaching the joining bracket with the pony tank to the main scuba tank, whereby a diver may quickly don or doff the pony tank.

4 Claims, 1 Drawing Sheet

MOUNTING SYSTEM FOR SECURING PONY TANK TO SCUBA MAIN CYLINDERS

BACKGROUND OF THE INVENTION

The instant invention relates generally to scuba diving equipment and more specifically it relates to a pony tank mounting system.

Numerous scuba diving equipment have been provided in prior art that are adapted to assist scuba divers when diving under water. While units may be suitable for the particular purpose to which they address, they would not be as suitable for the purposes of the present invention as heretofore described.

SUMMARY OF THE INVENTION

A primary object of the present invention is to provide a pony tank mounting system that will overcome the shortcomings of the prior art devices.

Another object is to provide a pony tank mounting system that will attach to any pony tank and will firmly secure the pony tank to any size main scuba tank, so that a diver may quickly and easily don or doff the pony tank.

An additional object is to provide a pony tank mounting system in which all hardware is affixed to a joining bracket, so that there is no need to utilize additional brackets for each set of main tanks being secured to the pony tank.

A further object is to provide a pony tank mounting system that is simple and easy to use.

A still further object is to provide a pony tank mounting system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
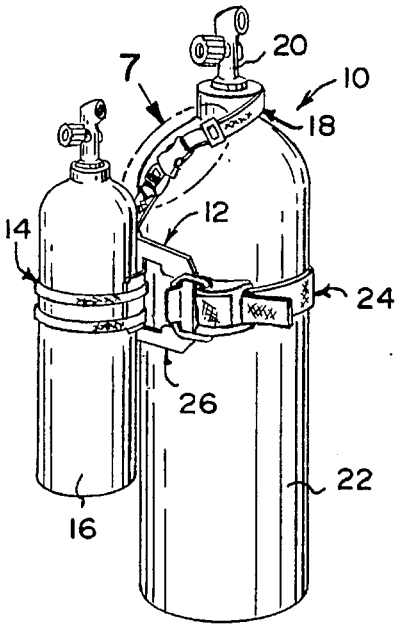
FIG. 1 is a diagrammatic perspective view illustrating the instant invention securing a pony tank to a single main scuba tank.

Turning now descriptively to the drawings, in which similar reference characters denote similar elements throughout the several views, FIG. 1 illustrates a pony tank mounting system 10 comprising a joining bracket 12. Components 14 are for securing the joining bracket 12 to a pony tank 16. A structure 18 is for suspending the joining bracket 12 with the pony tank 16 from a valve 20 on a main scuba tank 22. An assembly 24 is for attaching the joining bracket 12 with the pony tank 16 to the main scuba tank 22.

Figure 3:
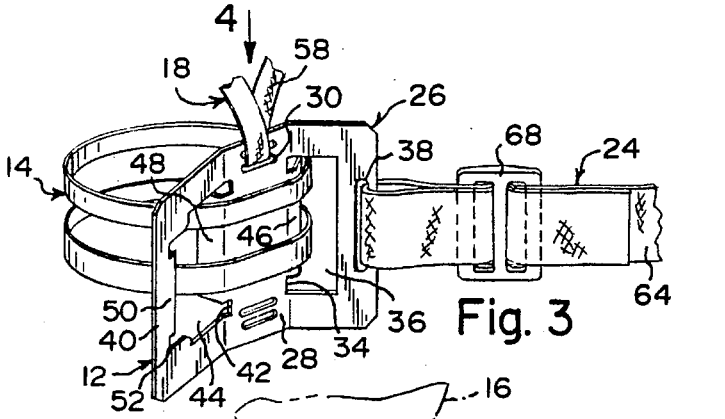
FIG. 3 is an enlarged diagrammatic rear perspective view of the instant invention per se with parts broken away.
Figure 4:
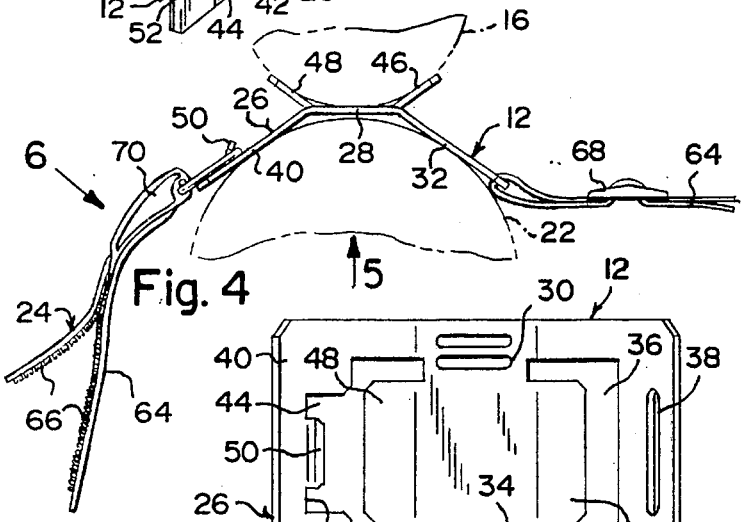
FIG. 4 is a diagrammatic top view taken in the direction of arrow 4 in FIG. 3 with parts broken away but showing the securing buckle for the main tank.
Figure 5:
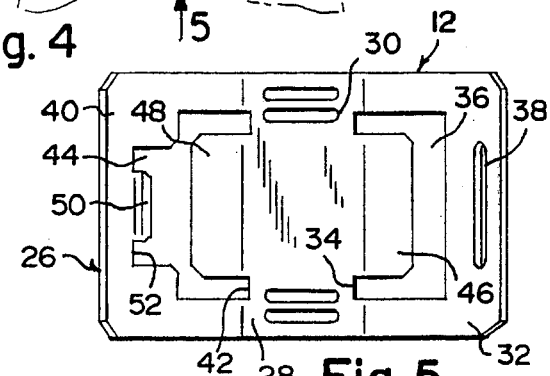
FIG. 5 is a diagrammatic rear view taken in the direction of arrow 5 in FIG. 4 of just the joining bracket per se.

The joining bracket 12, as best seen in FIGS. 3, 4 and 5, is a plate 26 which includes a central flat portion 28, having a top horizontal slot 30. A first wide flange 32 extends at an angle from a first side 34 of the central flat portion 28. The first wide flange 32 has a large aperture 36 therethrough and a large vertical side slot 38. A second wide flange 40 extends at an angle in the general direction as the first wide flange 32 from a second side 42 of the central flat portion 28. The second wide flange 40 has a large aperture 44 therethrough. A first narrow flange 46 extends at an angle from the first side 34 of the central flat portion 28 in the large aperture 36 of the first wide flange 32 in a general opposite direction than the first wide flange 32. A second narrow flange 48 extends at an angle from the second side 42 of the central flat portion 28 in the large aperture 44 of the second wide flange 40 in the general direction as the first narrow flange 46. An auxiliary narrow flange 50 extends at an angle from the side 52 of the large aperture 44 of the second wide flange 40 in the general direction as the second narrow flange 48. The first wide flange 32 and the second wide flange 40 will engage with the main scuba tank 22, the first narrow flange 46 and the second narrow flange 48 will engage with the pony tank 16.

Figure 8:
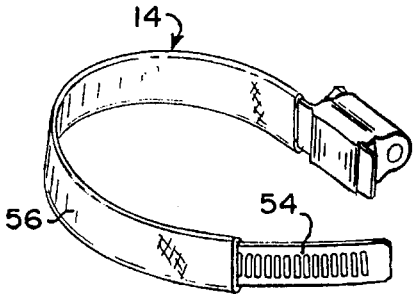
FIG. 8 is an enlarged diagrammatic perspective view illustrating a typical pony tank securing clamp.

The securing components 14 are a pair of large hose clamps 54 and a pair of sleeves 56. Each sleeve 56 fits over one hose clamp 54, as best shown in FIG. 8.

Figure 7:
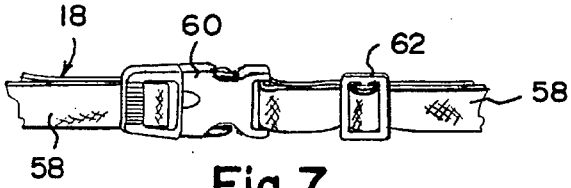
FIG. 7 is an enlarged diagrammatic perspective view taken in the area indicated by arrow 7 in FIG. 1.

The suspending structure 18, as best seen in FIG. 7, contains an elongated strap 58, to fit through the top horizontal slot 30 in the central flat portion 28 of the joining bracket 12. A quick-snap buckle 60 connects on opposite ends of the strap 58 to engage the strap 58 about the valve 20 of the main scuba tank 22. A slide member 62 on one end of the strap 58 is for adjusting the strap.

Figure 6:
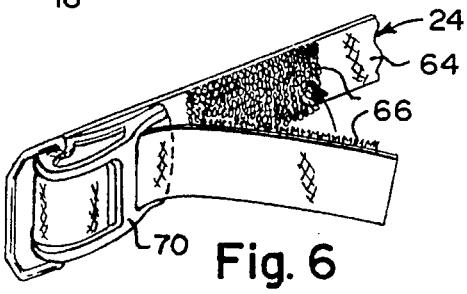
FIG. 6 is an enlarged diagrammatic perspective view taken generally in the direction of arrow 6 in FIG. 4 of the main tank securing buckle.

The attaching assembly 24, as best seen in FIGS. 3, 4 and 6, consists of an elongated belt 64 having a first end to fit through the large vertical side slot 38 in the first wide flange 32 of the joining bracket 12. Mating hook and loop pile fastener material pads 66 are affixed to the belt 64 adjacent a second end. A slide member 68 is on the first end of the belt 64, for adjusting the belt 64 to the joining bracket 12. A securing buckle 70 adjacent the second end of the belt 64 is held thereto by mechanical forces whereby the securing buckle 70 will engage with the auxiliary narrow flange 50 on the second wide flange 40 of the joining bracket 12.

Figure 2:
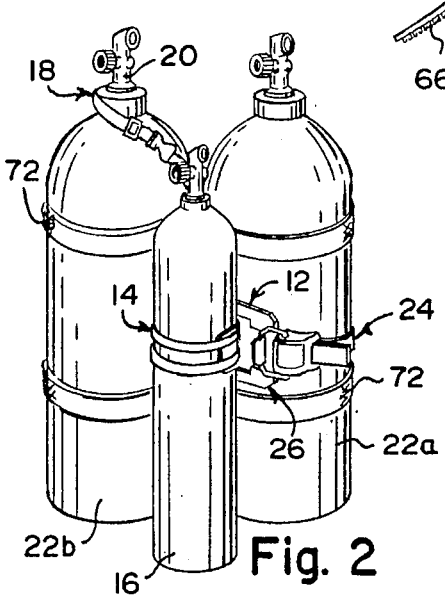
FIG. 2 is a diagrammatic perspective view illustrating the instant invention securing a pony tank to a set of two main scuba tanks.

FIG. 2 shows the pony tank mounting system 10 used in attaching the pony tank 16 to a first main scuba tank **22*a* of a pair of main scuba tanks. The scuba tanks 22*a* and 22*b* may be typically held together by a plurality of bands 72, as shown, or other mechanisms well known in the art but not illustrated. The suspending structure 18 in this instance, engages with the valve 20** on the second main scuba tank 22*b*, this prevent the joining bracket 12 from sliding toward a bottom of the main tank 22*a* or similarly 22 in FIG. 1.

OPERATION OF THE INVENTION

To use the pony tank mounting system 10, a person simply connects the securing components 14 about the pony tank 16. The suspending structure 18 is then hung about the valve 20 on the main scuba tank 22 and adjusted. The attaching assembly 24 then secures the joining bracket 12 to the main scuba tank 22. The pony tank 16 is now retained in place to the main scuba tank 22.

While certain novel features of this invention have been shown and described and are pointed out in the annexed claims, it will be understood that various omissions, substitutions and changes in the forms and details of the system illustrated and in its operation can be made by those skilled in the art without departing from the spirit of the invention.

What is claimed is:

1. A pony tank mounting system comprising:

a) a joining bracket, wherein said joining bracket is a plate which includes:

i) a central flat portion having a top horizontal slot;

ii) a first wide flange extending at an angle from a first side of said central flat portion, with said first wide flange having a large aperture therethrough and a large vertical side slot;

iii) a second wide flange extending at an angle in the general direction as said first wide flange from a second side of said central flat portion with said second wide flange having a large aperture therethrough;

iv) a first narrow flange extending at an angle from the first side of said central flat portion in the large aperture of said first wide flange in a general opposite direction than said first wide flange;

v) a second narrow flange extending at an angle from the second side of said central flat portion in the large aperture of said second wide flange in the general direction as said first narrow flange; and vi) an auxiliary narrow flange extending at an angle from the side of the large aperture of said second wide flange in the general direction as said second narrow flange, whereby said first wide flange and said second wide flange will engage with the main scuba tank, while said first narrow flange and said second narrow flange will engage with the pony tank;

b) means for securing said joining bracket to a pony tank;

c) means for suspending said joining bracket with said pony tank from a valve on a main scuba tank; and d) means for attaching said joining bracket with said pony tank to the main scuba tank.

2. A pony tank mounting system as recited in claim 1, wherein said securing means includes:

a) a pair of large hose clamps; and b) a pair of sleeves, each of which fits over one said hose clamp.

3. A pony tank mounting system as recited in claim 2, wherein said suspending means includes:

a) an elongated strap to fit through the top horizontal slot in said central flat portion of said joining bracket;

b) a quick-snap buckle to connect on opposite ends of said strap to engage said strap about the valve of the main scuba tank; and c) a slide member on one end of said strap for adjusting said strap.

4. A pony tank mounting system as recited in claim 3, wherein said attaching means includes:

a) an elongated belt having a first end to fit through the large vertical side slot in said first wide flange of said joining bracket;

b) mating hook and loop pile fastener material pads affixed to said belt adjacent a second end;

c) a slide member on the first end of said belt for adjusting said belt to said joining bracket; and d) a securing buckle adjacent the second end of said belt to be held thereto by mechanical forces, whereby said securing buckle will engage with said auxiliary narrow flange on said second wide flange of said joining bracket.

* * * * *